United States Patent [19]

Hyatt

[11] Patent Number: 4,800,823

[45] Date of Patent: Jan. 31, 1989

[54] AQUASAFE TM A TEMPERATURE TOLERANT SAFE

[76] Inventor: Gilbert P. Hyatt, P.O. Box 3357, Cerritos, Calif. 90703

[21] Appl. No.: 338,935

[22] Filed: Jan. 12, 1982

[51] Int. Cl.[4] ..... E05G 3/00; E04B 2/02

[52] U.S. Cl. ..... 109/24; 109/84

[58] Field of Search ..... 109/1 S, 1 V, 20, 24, 109/27, 65, 84; 109/78, 76, 82, 29, 84, 28

[56] References Cited

U.S. PATENT DOCUMENTS

| | | | |
|---|---|---|---|
| 131,842 | 10/1872 | Brook | 109/24 |
| 143,309 | 10/1873 | Stinson | 109/24 |
| 2,829,608 | 4/1958 | Blackburn et al. | 109/84 |
| 4,075,798 | 2/1978 | Tazaki | 109/29 |

FOREIGN PATENT DOCUMENTS

| | | | |
|---|---|---|---|
| 67511 | 4/1892 | Fed. Rep. of Germany | 109/84 |
| 10759 | 7/1903 | Fed. Rep. of Germany | 109/24 |
| 18431 | 8/1903 | Fed. Rep. of Germany | 109/24 |
| 27538 | 12/1912 | Fed. Rep. of Germany | 109/24 |
| 437045 | 11/1967 | Switzerland | 109/29 |
| 231851 | 9/1926 | United Kingdom | 109/38 |

*Primary Examiner*—John Weiss

*Attorney, Agent, or Firm*—Gilbert P. Hyatt

[57] ABSTRACT

An improved storage device is provided for enhanced protection from fire and theft. It has advantages of lightweight for transportation and installation, heavyweight for protection when in use, steel construction for theft protection, dry insulation for heat flow retardation, fluid for limiting internal temperature rise and low cost. These capabilities are achieved by constructing a multi-walled storage device having an inner wall of steel for theft protection, an outer chamber of insulation to reduce heat flow from an external source, and an internal chamber for filling with a fluid to absorb heat and thereby reduce the maximum temperature. The fluid boils off at a particular temperature and pressure to limit internal temperature. The outer insulation limits heat flow, thereby reducing the rate that fluid boils off. Duration of temperature limit protection is a function of heat capacity and heat of vaporization of the fluid and heat flow through the insulation. Use of dry insulation enhances resistance to high temperature before the fluid is fully boiled-off and therefore before the internal temperature can rise above the fluid boiling temperature.

8 Claims, 1 Drawing Sheet

AQUASAFE TM A TEMPERATURE TOLERANT SAFE

BACKGROUND OF THE INVENTION

1. Field of the Invention

The field of the invention is the protection of stored items and, in particular, the protection of items from fire and theft.

2. Prior Art

The prior art in vaults and safes is dominated by theft proof safes having thick steel construction. Also, the prior art includes cabinets having dry insulation to partially protect against externally generated heat such as from a fire. Such devices are conventionally delivered in assembled form, where the delivered weight is equal to the weight in use, less the weight of the contents stored therein. A heavy vault or safe discourages theft by reducing the possibility of the cabinet or safe being carried away by a thief. However, weight that is sufficient to permit installation is typically insufficient to prevent it from being carried away by a thief. Similarly, weight that is sufficient to inhibit being carried away by a thief is excessive for convenient installation.

SUMMARY OF THE INVENTION

The present invention is directed to the Aquasafe TM, a storage device such as cabinet or safe for protection from theft and from fire at lower cost and greater convenience. In one embodiment, the Aquasafe TM includes three primary elements; a steel structure to inhibit penetration such as by a thief; insulation to inhibit heat flow such as from a fire; and a fluid, ablative material, or other material that can boil off or burn off or vaporize to reduce maximum internal temperatures. Further, this material may provide increased tolerance to penetration such as explosion resistance and energy absorption. The improved storage device of the present invention can be relatively lightweight for transportation and installation and heavyweight for use Transportation and installation can be in a dry or fluidless form with the fluid chamber empty. After installation, a fluid chamber can be filled to provide extra weight for reducing the possibility of the cabinet being carried away by a thief and to limit the internal temperature such as during a fire. Limiting of the internal temperature is related to the boiling or ablative point of the material, where the material can be permitted to evaporate during over-temperature conditions.

An objective of the present invention is to provide an improved means and method for reducing theft.

Another objective of the present invention is to provide an improved means and method for reducing heat damage.

Another objective of the present invention is to provide an improved safe.

Another objective of the present invention is to provide an improved cabinet.

Another objective of the present invention is to provide an improved means and method for limiting temperature of stored items.

Another objective of the present invention is to provide an improved means and method for explosion tolerance.

Another objective of the present invention is to provide an improved means and method for heat conduction.

The foregoing and other objects, features, and advantages of the present invention will become apparent from the following detailed descriptions of preferred embodiments of this invention as illustrated in the accompanying drawings.

BRIEF DESCRIPTION OF THE DRAWINGS

A better understanding of the present invention may be obtained from a consideration of the detailed description hereinafter taken in conjunction with the drawings, which are briefly described below.

FIG. 2 comprising

DETAILED DESCRIPTION OF THE INVENTION

The system of the present invention can take any of a number of forms. Illustrative embodiments of several arrangements of the present invention are found in the accompanying figures and are described hereinafter.

Figure 1:
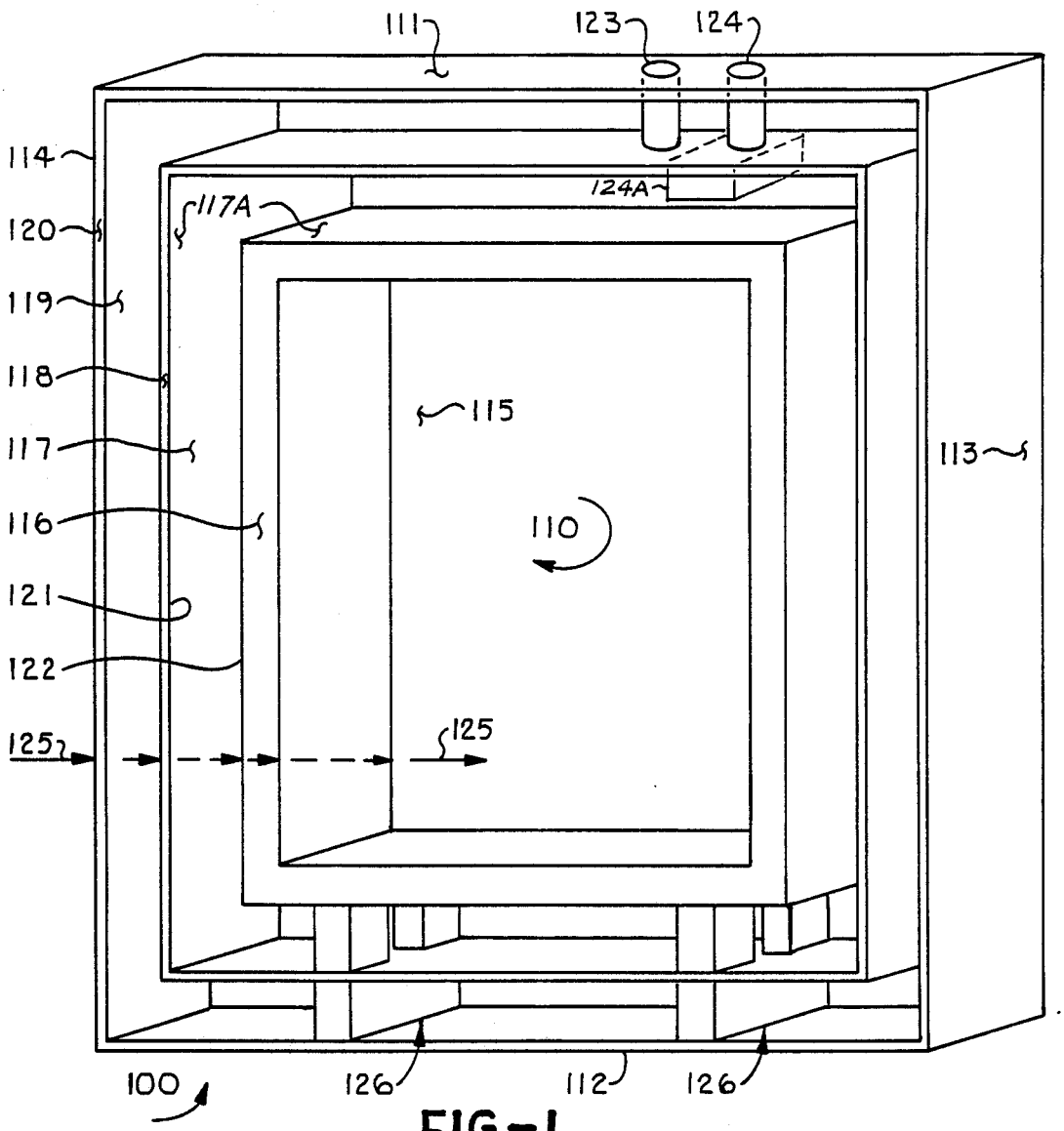
FIG. 1 is a diagramatical representation of a means and method for discouraging theft of stored materials and for reducing potential of heat damage to stored materials.

One embodiment of the Aquasafe TM system is shown in FIG. 1. This embodiment is discussed relative to a storage device such as a cabinet, safe, or vault having a fluid for enhanced protection from fire and theft; which discussion is illustrative of the broader features and uses of the present invention. System 100 includes internal space 110 that is insulated, penetration resistant and temperature resistant. Means and methods for achieving these results are discussed hereinafter.

The system of the present invention provides an effective and inexpensive means and method for limiting temperature of a storage device. In a preferred embodiment, it can boil off fluid to limit temperature of stored materials contained therein. An outer layer of insulation can reduce heat flow therethrough to a relatively low heat flow rate. A fluid contained therein such as water may have a relatively high specific heat, density, and heat of vaporization. Therefore, the relatively small amount of the heat flowing through the outer insulation can be absorbed by the fluid, causing the fluid to increase in temperature and eventually to vaporize; thereby limiting heat flow to the materials stored therein. The relatively high capacity of the fluid to absorb heat through temperature rise and vaporization and the relatively small amount of heat flow through the outer insulation can provide protection for extended periods of time with relatively small amounts of fluid. For example, preliminary calculations indicated that inexpensive commercially available insulation and an acceptable amount of water can protect relatively large safes for 24 hours in a high temperature fire environment.

Figure 2A:
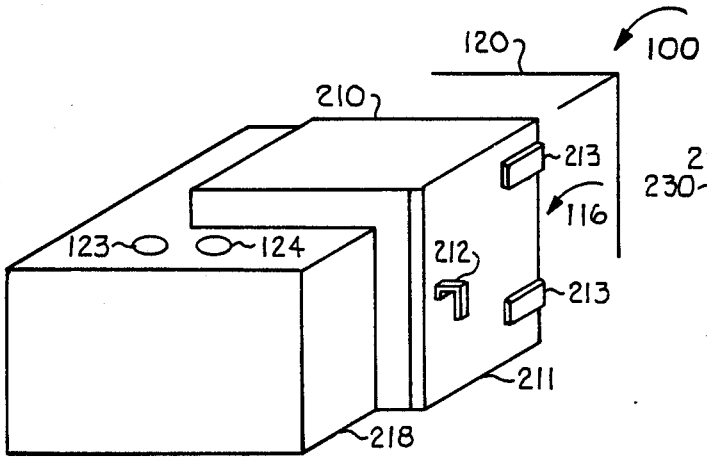
FIGS. 2A and 2B shows alternate embodiments of the arrangement shown in FIG. 1.

Materials can be stored in the storage device, shown as having the conventional six sides of a cubic or rectangular enclosure. The six sides can include a top 111, a bottom 112, a right side 113, and a left side 114. The fifth side can be a backside 115 and the sixth side can be a front side, shown cutaway in FIG. 1. In one embodiment, the front side can be a door 211 mounted on hinges 213 (FIG. 2) in a fashion usual for cabinets, safes, and vaults. Also, conventional cabinet, safe, and vault type fastening devices may be used to attach the door.

The structure may be composed of the walls, shells, or other structures such as inner structure 116, intermediate structure 118, and outer structure 120. In one embodiment shown in FIG. 1; structures 116, 118, and 120 can be steel structures having containers with standoffs or mounts 126 therebetween to maintain these structures separated therebetween. Outer container 119 between structures 118 and 120 can be filled with an insulation material such as fiberglass, foam, or polystyrene dry insulation. Inner container 117 between structures 116 and 118 can be filled with a fluid such as water. Inner surface 121 of intermediate structure 118 and outer surface 122 of inner structure 116 may be coated with fluid resistant materials such as plastic, paint, deposits, diffusions and other coatings to reduce erosion from the fluid in container 117. Structures 116, 118, and 120 may have deposited coatings of copper or other material for heat conduction to distribute heat 125 flowing through system 100 evenly over the surface of structures 116, 118, and 120 and to conduct heat to fluid in container 117.

Heat flow to the interior may be reduced with a reflective coating such as on the outer surface of structures 116, 118, and 120. Reflective coatings may be formed with paint, films, plating, foil, and other arrangements.

In one embodiment, outer structure 120 and intermediate structure 118 may be relatively thin walled for providing structural support for insulation in container 119, fluid in container 117, and internal contents in container 110. Inner structure 116 may be a thick walled steel structure that is resistant to shock, explosions, drilling and other penetration methods as is well known in the art of safe and vault construction. In one embodiment, outer structure 120 and intermediate structure 118 may be thinner then inner structure 116 with sufficient structure to contain insulation in container 119 and fluid in container 117 and the various auxiliary devices such as pressure relief valve 123 and fill valve 124 without degrading the integrity of inner structure 116. However, in alternate embodiments outer structure 120, intermediate structure 118, and inner structure 116 may have relative sizes, thicknesses, toughnesses, and other characteristics to facilitate protection from theft and heat.

Weight of the Aquasafe TM may be a deterent to theft. Weight of the structure and weight of the fluid contribute to this theft deterrent. However, a thief skilled in construction of the Aquasafe TM may circumvent some of its advantages by penetrating the outer structures and draining fluid for reduction of weight to facilitate removal or for reduction of heat tolerance to faciliate destruction of the contents such as by arson. Consequently, in an alternate embodiment, additional weight and heat reduction devices may be enclosed within a more substantial protective structure. For example, in one embodiment, inner structure 116 may contain additional materials to increase weight and to increase heat tolerance. In another embodiment an outer structure such as outer structure 120 or intermediate structure 118 may include sturdy construction to reduce penetration by a thief or arsonist. These embodiments are exemplary of a range of embodiments that can be used to reduce the possibility of circumvention by a thief or arsonist.

Fill valve 124 may be used to fill inner chamber 117 with fluid. This permits transportation and installation of an unfilled system 100 for a lightweight and shock tolerant structure. After installation, inner chamber 117 can be filled with fluid through valve 124 for greater weight and for limiting internal temperature. Greater weight facilitates discouragement of a thief from carrying off system 100. Fluid facilitates limiting internal temperatures by permitting the fluid to vaporize as heat flow 125 through the structure tends to raise the internal temperature of storage volume 110.

The arrangement of the Aquasafe TM discussed herein can provide the additional advantages of greater tolerance to explosions and other penetration considerations. For example, the multiwalled structure shown in FIGS. 1 and 2 enhances resistance to penetration. Further, the fluid contained therein has energy absorption ability and can absorb explosions and other energy. Further, pressure relief valve 123 can vent fluid at a particular pressure to absorb energy of an explosive type shock. Also, the need to penetrate various structures 116, 118, and 120 and materials therebetween to access main structure 116 may further discourage a thief. Therefore, the system of the present invention has many advantages in addition to the structural strength, insulation against heat, and heat related vaporization of fluid.

In one embodiment, the structural sequence shown in FIG. 1, may be used. This provides relative thin outer structure 120 and intermediate structure 118 for containing insulation 119 and fluid 117 and a relatively thick inner structure 116 for discouraging penetration by a thief in combination with insulation 119 being outside of fluid 116 to reduce heat flow 125 to fluid 117 and to material stored in the interior 110. As heat flow 125 increases the temperature of the fluid in inner container 116 to its vapor point; the fluid will begin to vaporize, thereby absorbing heat flowing through the insulation. In one embodiment, the fluid may not be pressurized and may be permitted to boil off at atmospheric pressure. In another embodiment, pressurization may be used. As the fluid begins to vaporize, the pressure in inner container 116 will rise. As the pressure in inner container 116 builds up, a pressure relief valve 123 can be used to vent the pressure when the pressure reaches the valve actuation pressure level. This facilitates control of pressure in inner container 116 to limit the amount of vapor that escapes and to increase the heat that is removed with the escaping fluid. For example, if the fluid in inner container 116 was water, the water would boil-off at atmospheric pressure at a temperature of about 212° F. However, 212° F. may be readily tolerable by normal stored materials. Therefore, pressure relief valve 123 might be set to a higher pressure such as related to 250° F. to facilitate a higher temperature boiling point and boil-off temperature. Alternately, pressure relief valve 123 can be a temperature relief valve or other type of valve to facilitate maintaining the stored materials in container 110 within a maximum selected temperature such as by venting pressure at a particular temperature.

Relief valve 123 and fill valve 124 may tend to degrade the integrity of system 100 relative to circumvention by a thief or arsonist. Therefore, valves 123 and 124 may be located in inconspicuous places and may be camouflaged by being blended into an outer surface such as into top 111 to reduce detection thereof Also, valves 123 and 124 may be small valves to reduce detection. Further, camouflage techniques such as distributing dummy valve type indentations or features throughout the outer surface of system 100 facilitate camouflaging the location of the actual valves. In other embodiments valves 123 and 124 may have ducts to conduct filling and venting fluids from and to bottom 112 of system 100 for filling and venting from underneath system 100 to minimize access by a thief or arsonist.

Fluid contained in inner chamber 116 can limit the internal temperature for a period of time until the fluid is exhausted. After the fluid is exhausted, the internal temperature is primarily limited by the temperature of outer shell 120 and the insulating characteristics of insulation 119. However, a refill capability during operation can increase the period of time for which the fluid can limit the internal temperature. This can be provided with a fill valve 124 and a source of fluid accessed through valve 124 to refill the fluid at the appropriate time. Refilling can be accomplished with a well known fluid level detector 124A. A common fluid level control is implemented in conventional flush and refill arrangements for a common household toilet.

System 100 can be used for a self contained application such as self contained safe located in a building and for a portable application such as a portable safe that can be transported. However, system 100 can also be used for a built-in application such as a vault in a bank. In such built-in systems, inner structure 116 can be the usual structure of a safe or vault and intermediate structure 118, outer structure 120, fluid chamber 117, and insulation chamber 119 may be built around the vault such as outside of the adjacent walls and ceiling of the vault.

An alternate embodiment of the Aquasafe TM of the present invention will now be described with reference to FIG. 2. System 100 may include a six sided rectangle including five sealed sides 210 comprising a top, bottom, right side, left side, and rear and may also include a door 211 on the front side. Door 211 may include handle 212 and hinges 213. Fluid container 118 may surround portions of the system such as the side and rear portions. Fluid container 218 may include fill port 124 and pressure relief valve 123, as discussed with reference to FIG. 1 above Surfaces 200 and 211 may be good thermal conductors to conduct heat to fluid container 218 for heat removal from the cabinet to the fluid. The fluid may absorb heat for removal thereof and may vaporize and vent through relief valve 123.

Enclosure 210 and 211 may be made of a good conductor of heat such as metal. Heat conduction may been enhanced with coatings of good conductive material such as copper, silver, or other coatings. Heat conductive coatings may be plated, deposited, bonded, cladded, or otherwise attached to the surfaces.

Conductive coatings will now be exemplified with a discussion of a copper foil. Copper foil may be an electrolytic copper foil or electrolytic nickel foil such as used in the printed circuit board art. Such foil may range from about 0.17 mils to 14 mils (a mil is 0.001 inches) in thickness. These foils may be made in continuous rolls or sheets and may range up to 94 inches in width or more. Foil ma be laminated to surfaces as is well known in the printed circuit art, where foil is laminated to printed circuit board substrates. Typical printed circuit board foil is manufactured by Gould Inc, Foil Division, headquartered in Chicago, Ill. In the printed circuit board art, the foil is bonded to the printed circuit substrate which may be a type of phenolic epoxy, glass epoxy, glass polyester, or other material. Similarly, foil may be bonded to surfaces of system 100 (FIGS. 1 and 2 herein).

Fluid container 218 may completely surround the cabinet as shown in FIG. 1, or may partially surround the cabinet as shown in FIG. 2. Fluid container 118 may be attached to one or more surfaces of the container for conduction of heat thereto. Alternately, container 218 may be set apart and not connected to any surfaces of the cabinet, where heat may be conducted thereto with a heat pipe or heat conductive surface for cooling of the cabinet.

The arrangement shown in FIG. 2 illustrates a cabinet and a fluid container. However, in a preferred embodiment, the container and fluid cabinet may be surrounded with an insulation container 120 having insulation therein to reduce heat flow to the internal enclosure 116 and to fluid container 218.

In the arrangement shown in FIG. 2, heat that flows through outer structure 120 and through insulation contained therein to inner structure 116 may not pass through fluid container 218 but may pass directly to door 211 or other portions of system 100 not enclosed by fluid container 218. However, door 2111 is connected to sides 210, where door 211 and sides 210 may be constructed of heavy gauge steel or other metal. Therefore, heat flow direct to door 211 will be conducted to sides 210 an to fluid container 218. Fluid container 218 will absorb heat from sides 210 to limit temperatures, as discussed therein. Although door 211 may be hotter than fluid cooled side 210, the good conductivity of metal should make the temperature gradient from door 211 to sides 210 relatively small. This temperature gradient can be further reduced by enhancing heat conduction, such as with a good conductive coating of copper, nickel, silver, or other coating.

Figure 2B:
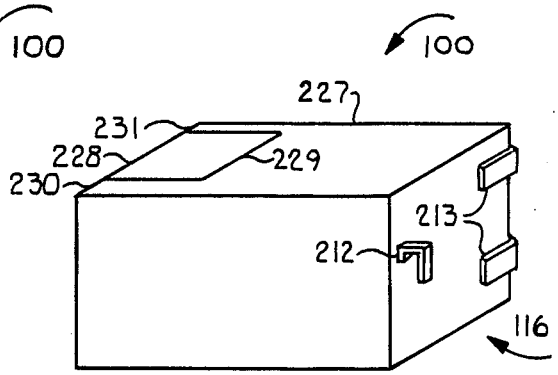

Another alternate embodiment of the Aquasafe TM 100 is shown in FIG. 2B. Storage device 227 may have fluid container 228 attached thereto such as in contact therewith at the rear 229 of storage device 227 and may have thermal conduction devices 230 and 231 in contact therewith for conducting heat from storage device 227. The arrangement shown in FIG. 2B may include features discussed with reference to FIGS. 1 and 2A such as having surrounding structures and surrounding insulation.

Fluid contained in system 100 may introduce considerations of corrosion and contamination. Therefore, various additives may be provided including antioxidants such as rust and corrosion inhibitors, antibacterial solutions, and antifreeze. Anti-oxidants are well known in the automotive art such as rust inhibitors for automotive radiators. Antibacterial solutions are well known in the waterbed art such as antibacterial additives for waterbeds. Also, rust may be inhibited implicit in the construction. For example, use of material such as stainless steel may implicity be tolerant to fluids and resistance to rust. Stainless steel provides high toughness and strength and also provides excellent characteristics for safes and vaults such as strength and tolerance to penetration. Other methods may also be used to protect from fluid effects. For example, the inner surface 121 of structure 118 and the outer surface 122 of structure 116 in container 117 may be coated with rust resistant materials such as plastic coatings, rubber coatings, plated coatings, seals, epoxys, and other materials. Also, container 117 can be lined with a bag, bladder, or other arrangement to 117A, as with the above mentioned material coatings, contain a fluid.

For simplicity of discussion, the fluid in container 117 may be discussed herein as water. However, other fluids may be used having various desireable characteristics such as greater specific heat, greater heat of vaporization, greater density, or other characteristics. However, water has an excellent specific heat of vaporization and density. Also, water is readily available and relatively easy to use. Nevertheless, other materials may also be used. For example, methyl alcohol, ethynol, and other such materials having relatively high boiling temperatures and relatively good antirust characteristics may be used. Also, ablative materials that can burn off or boil off ma be used.

The Aquasafe TM system of the present invention has been discussed in the form of a fluid cooled safe, cabinet, or vault. However, the teachings of the present invention are equally applicable for protection of other devices from heat. For example, the arrangements shown in FIGS. 1 and 2 may be other structures such as rooms, buildings, and vehicles. Also, the system of the present invention can provide for protecting humans from heat. For example, the arrangements shown in FIGS. 1 and 2 may be arranged in the form of a thermal suit, housing, or other arrangement for protecting a person.

RELATION TO OTHER MATERIALS

The instant application was disclosed in Disclosure Documents filed in the Patent and Trademark Office No. 099,319 filed on April 16, 1981 and No. 100,197 filed on May 18, 1981; establishing conception and diligence for the instant invention; wherein said Disclosure Documents are herein incorporated by reference.

From the above description it will be apparent that there is thus provided a device of the character described possessing the particular features of advantage before enumerated as desireable, but which obviously is susceptible to modification in it's form, method, mechanization, operation, detailed construction and arrangement of parts without departing from the principles involved or sacrificing any of its advantages.

While in order to comply with the statute, the invention has been described in language more or less specific as to structural features, it is to be understood that the invention is not limited to the specific features shown, but that the means, method, and construction herein disclosed comprise the preferred form of several modes of putting the invention into effect, and the invention is, therefore, claimed in any of its forms or modifications within the legitimate and valid scope of the appended claims,

What I claim is:

1. A storage system comprising:
means for storing materials and
means for reducing temperature of the materials stored in said storing means, said temperature reducing means including;
(a) a fluid container for containing fluid,
(b) a thermal conductor for conducting heat between said material storing means and said fluid container,
(c) means for evaporating fluid contained in said fluid container to remove heat conducted by said thermal conductor,
(d) means for sensing the amount of fluid contained in said fluid container, and
(e) means for adding fluid to said fluid container in response to the sensing of the amount of fluid by said sensing means to replace fluid evaporated by said evaporating means.

2. *A storage* system *comprising:*
a safe for *storing* materials *to be protected* from theft and
*means for reducing temperature of the materials stored in said safe, said temperature reducing means including;*
(a) *a fluid container for containing fluid,*
(b) *a thermal conductor for conducting heat between said safe and said fluid container,*
(c) *means for evaporating fluid contained in said fluid container to remove heat conducted by said thermal conductor,*
(d) means for sensing level of the fluid *contained in said fluid container,* and
(e) means for adding fluid *to said fluid container* to maintain a level *in response to the sensing of the level of the fluid by said sensing means to replace fluid evaporated by said evaporating means.*

3. The system as set forth in claim 2 above, wherein said temperature reducing means further includes ablative means for reducing temperature by ablative process.

4. The system as set forth in claim 1 above, wherein the fluid contained in said fluid container includes antifreeze for inhibiting freezing and includes means for inhibiting corrosion.

5. (Once amended) [The] *A storage* system [as set forth in claim 1 above, wherein said] *comprising:*
*means for storing materials and*
*means for reducing temperature of the materials stored in said storing means, said temperature reducing means including;*
(a) *a fluid container for containing fluid,*
(b) *a* thermal conductor [includes] *having* metallic plating on said material storing means for [said] conducting of heat *between said material storing means and said fluid container,*
(c) *means for evaporating fluid contained in said fluid container to remove heat conducted by said thermal conductor,*
(d) *means for sensing the amount of fluid contained in said fluid container, and*
(e) *means for adding fluid to said fluid container in response to the sensing of the amount of fluid by said sensing means to replace fluid evaporated by said evaporating means.*

6. (Once amended) [The] *a storage* system [as set forth in claim 1 above, wherein said] *comprising:*
*means for storing materials and*
*means for reducing temperature of the materials stored in said storing means, said temperature reducing means including;*
(a) *a fluid container for containing fluid,*
(b) *a thermal conductor for conducting heat between said material storing means and said fluid container,*
(c) *means for evaporating fluid contained in said fluid container to remove heat conducted by said thermal conductor,*
(d) sensing means [includes means] for sensing fluid level *in said fluid container,* and [wherein said]
(e) [fluid adding means includes] a valve for adding fluid *to said fluid container* to maintain a fluid level sensed [with] *by* said sensing means *by replacing fluid evaporated by said evaporating means.*

7. A storage system comprising:
means for storing materials;

temperature reducing means for reducing temperature of the materials stored in said storing means, wherein said temperature reducing means includes
(a) an outer structure for containing dry insulation and
(b) a middle structure for containing fluid, wherein said storing means includes an inner structure for storing the materials, and wherein said inner structure is thicker than said outer structure and said middle structure;
means for sensing level of the fluid contained in said middle structure; and
means for adding fluid to the fluid contained in said middle structure in response to sensing of level of the fluid contained in said middle structure.

8. (Twice amended amended) A storage system comprising:
means for storing materials and
temperature reducing means for reducing temperature of the materials stored in said storing means, wherein said temperature reducing means includes
(a) an outer structure for containing dry insulation,
(b) a middle structure for containing fluid,
(c) means for reducing temperature of the materials [with] *by* fluid evaporation,
(d) means for sensing fluid level, and
(e) means for adding fluid to maintain a fluid level;
wherein said storing means includes an inner structure for containing the materials and wherein said inner structure is thicker than said outer structure and said middle structure.

* * * * *